US012747899B2

(12) United States Patent
Jin et al.

(10) Patent No.: US 12,747,899 B2
(45) Date of Patent: Sep. 29, 2026

(54) MOTOR DRIVE SYSTEM AND CONTROL METHOD FOR CHILLER UNIT

(71) Applicant: Carrier Corporation, Palm Beach Gardens, FL (US)

(72) Inventors: Da Jin, Shanghai (CN); Zhizhong Xiang, Shanghai (CN); Lei Jing, Shanghai (CN); Yongliang Hu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 108 days.

(21) Appl. No.: 18/761,589

(22) Filed: Jul. 2, 2024

(65) Prior Publication Data

US 2025/0012498 A1 Jan. 9, 2025

(30) Foreign Application Priority Data

Jul. 4, 2023 (CN) ..... 202310815394.5

(51) Int. Cl.
*F25B 49/02* (2006.01)

(52) U.S. Cl.
CPC ..... *F25B 49/025* (2013.01); *F25B 2600/024* (2013.01)

(58) Field of Classification Search
CPC ..... F25B 49/025; F25B 2600/024; F25B 2600/0253; F25B 49/022; F25B 1/10; F25B 1/047; F25B 49/02; F04C 28/08; Y02B 30/70
See application file for complete search history.

(56) References Cited

U.S. PATENT DOCUMENTS 4,787,211 A 11/1988 Shaw
2005/0086960 A1* 4/2005 Yokozeki ..... F25B 49/025 62/228.3
2007/0056300 A1* 3/2007 Crane ..... F25B 49/025 62/175

(Continued)

FOREIGN PATENT DOCUMENTS

CN 115095915 A * 9/2022 ..... F24F 1/16
CN 115095916 A * 9/2022 ..... F24F 1/0063
CN 218627885 U 3/2023

(Continued)

OTHER PUBLICATIONS

Extended European Search Report received for EP Application No. 24186509.6, mailed on Oct. 14, 2024, 7 Pages.

*Primary Examiner* — Kun Kai Ma
(74) *Attorney, Agent, or Firm* — Drew Folgmann

(57) ABSTRACT

The present application relates to air conditioning technology and motor control technology, and in particular to a motor drive system for a chiller unit, a chiller unit comprising the motor drive system, a control method for a chiller unit, and a computer-readable storage medium on which is stored a computer program for implementing the method. A motor drive system for a chiller unit according to an aspect of the present application comprising: a variable frequency drive unit configured to drive a first motor; a power frequency drive unit configured to drive a second motor; and a control unit configured to adapt a load demand of the chiller unit by controlling output power of the variable frequency drive unit and the power frequency drive unit.

19 Claims, 4 Drawing Sheets

(56) References Cited

U.S. PATENT DOCUMENTS

| | | | | |
|---|---|---|---|---|
| 2012/0210736 | A1* | 8/2012 | Rockenfeller | F25B 7/00 62/115 |
| 2025/0003618 | A1* | 1/2025 | Heenehan | F24F 11/88 |

FOREIGN PATENT DOCUMENTS

| | | | | |
|---|---|---|---|---|
| EP | 3339653 | A1 * | 6/2018 | F04D 27/0269 |
| EP | 4604381 | A1 * | 8/2025 | F25B 49/025 |
| JP | 2005180748 | A | 7/2005 | |
| NO | 338790 | B1 * | 10/2016 | F04D 13/08 |
| TW | M486019 | U * | 9/2014 | |

* cited by examiner

MOTOR DRIVE SYSTEM AND CONTROL METHOD FOR CHILLER UNIT

CROSS REFERENCE TO A RELATED APPLICATION

The application claims the benefit of China Patent Application No. 202310815394.5 filed Jul. 4, 2023, the contents of which are hereby incorporated in their entirety.

TECHNICAL FIELD

The present application relates to air conditioning technology and motor control technology, and in particular to a motor drive system for a chiller unit, a chiller unit comprising the motor drive system, a control method for a chiller unit, and a computer-readable storage medium on which is stored a computer program for implementing the method.

BACKGROUND

Screw chiller unit is a chiller unit with various forms of screw compressor as a host, which is increasingly widely used in the field of refrigeration and air conditioning. A typical screw chiller unit includes a screw compressor, condenser, evaporator, expansion mechanism, oil separator, as well as self-control components and instruments.

For the sake of energy conservation and efficiency improvement, the motor used for the compressor often utilizes a variable frequency drive as the driving component. However, the variable frequency drive is expensive, which leads to an extended investment payback period, especially when the screw chiller unit includes multiple compressors, the above problem is particularly prominent.

SUMMARY

In accordance with an aspect of the present application, there is provided a motor drive system for a chiller unit, the chiller unit comprising a first compressor, a first motor for the first compressor, a second compressor and a second motor for the second compressor, the motor drive system comprising:

a variable frequency drive unit configured to drive the first motor;

a power frequency drive unit configured to drive the second motor; and a control unit configured to adapt a load demand of the chiller unit by controlling output power of the variable frequency drive unit and the power frequency drive unit.

Optionally, in the motor drive system, a rated power of the first compressor is greater than or equal to a rated power of the second compressor.

Optionally, in the motor drive system, the number of the first compressors is one and the number of the second compressors is one or more.

Optionally, in the motor drive system, the control unit controls the output power of the variable frequency drive unit and the power frequency drive unit in the following manner:

adapting the load demand by operating only the variable frequency drive unit when the load demand is less than or equal to a first critical value, wherein the variable frequency drive unit is operated at a variable output power;

adapting the load demand by operating the variable frequency drive unit and the power frequency drive unit when the load demand is greater than a second critical value and less than a third critical value, wherein the variable frequency drive unit is operated at a first output power and the power frequency drive unit is operated at a variable output power, wherein the second critical value is greater than or equal to the first critical value; and adapting the load demand by operating the variable frequency drive unit and the power frequency drive unit when the load demand is greater than or equal to the third critical value, wherein the variable frequency drive unit is operated at a variable output power and the power frequency drive unit is operated at a second output power.

Further optionally, in the motor drive system, the first output power is less than the output power of the variable frequency drive unit when the load demand is equal to the first critical value, and the second output power is equal to a maximum output power of the power frequency drive unit.

Alternatively, in the motor drive system, the first compressor and the second compressor are same types of compressors, the chiller unit is a screw chiller unit, and the first critical value is 50% of a rated load demand of the screw chiller unit.

Alternatively, in the motor drive system, the first compressor and the second compressor are different types of compressors, the chiller unit is a screw chiller unit, and the first critical value is 40% of a rated load demand of the screw chiller unit.

In accordance with another aspect of the present application, there is provided a chiller unit comprising:

a first compressor;

a first motor for the first compressor;

a second compressor;

a second motor for the second compressor; and a motor drive system comprising:

a variable frequency drive unit configured to drive the first motor;

a power frequency drive unit configured to drive the second motor; and a control unit configured to adapt a load demand of the chiller unit by controlling output power of the variable frequency drive unit and the power frequency drive unit.

In accordance with a further aspect of the present application, there is provided a control method for a chiller unit, the chiller unit comprising a first compressor, a first motor for the first compressor, a second compressor and a second motor for the second compressor, the method comprising:

utilizing a variable frequency drive unit and a power frequency drive unit to drive the first motor and the second motor, respectively, wherein a load demand of the chiller unit is adapted by controlling output power of the variable frequency drive unit and the power frequency drive unit.

In accordance with a still further aspect of the present application, there is provided a computer-readable storage medium on which a computer program suitable for running on a processor of a terminal device is stored, the running of the computer program resulting in the steps of the method as described above being performed.

DESCRIPTION OF THE DRAWINGS

The above and/or other aspects and advantages of the present application will be clearer and more easily understood from the following description of various aspects in conjunction with the accompanying drawings, in which the same or similar units are denoted by the same reference numerals. The accompanying drawings include.

DETAILED DESCRIPTION

The present application is described more fully below with reference to the accompanying drawings, in which illustrative embodiments of the application are illustrated. However, the present application may be implemented in different forms and should not be construed as limited to the embodiments presented herein. The presented embodiments are intended to make the disclosure herein comprehensive and complete, so as to more comprehensively convey the protection scope of the application to those skilled in the art.

In this specification, terms such as "comprising" and "including" mean that in addition to units and steps that are directly and clearly stated in the specification and claims, the technical solution of the application does not exclude the presence of other units and steps that are not directly or clearly stated in the specification and claims.

Unless otherwise specified, terms such as "first" and "second" do not indicate the order of the units in terms of time, space, size, etc., but are merely used to distinguish the units.

Figure 1:
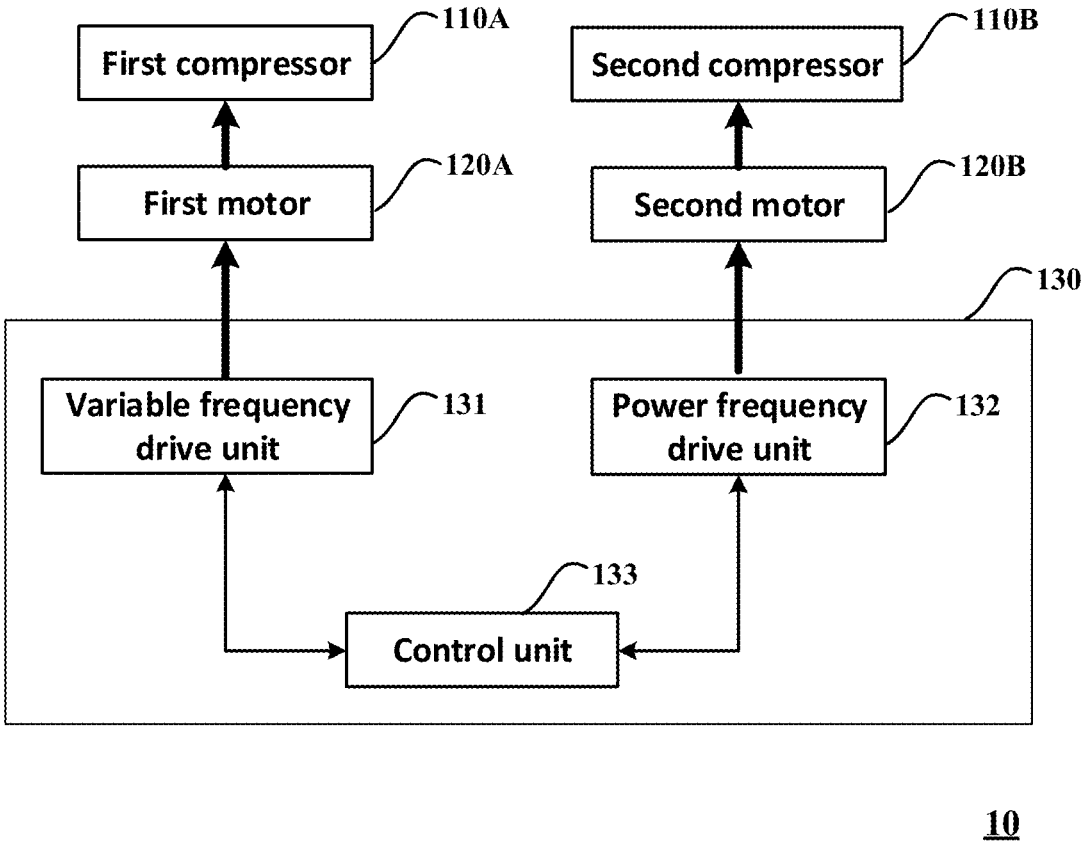
FIG. 1 is a schematic block diagram of a screw chiller unit in accordance with some embodiments of the present application.

FIG. 1 is a schematic block diagram of a screw chiller unit in accordance with some embodiments of the present application. It should be noted that, in addition to the units shown in FIG. 1, the screw chiller unit also includes other essential units for implementing refrigeration functions. However, for the sake of simplicity, FIG. 1 and the following description will relate only to units directly related to the technical problem solved by the present application. Furthermore, the screw chiller unit described herein is merely exemplary, and the embodiments described herein may also be applied to other types of chiller units.

A screw chiller unit 10 shown in FIG. 1 includes a first compressor 110A, a second compressor 110B, a first motor 120A, a second motor 120B, and a motor drive system 130. Exemplarily, the first compressor 110A and the second compressor 110B are connected to different circuits of the screw chiller unit respectively, and the first motor 120A and the second motor 120B serve as power sources for the first compressor 110A and the second compressor 110B, respectively. In addition, the motor drive system 130 is configured to drive the first motor 120A and the second motor 120B so that the first motor 120A and the second motor 120B operate at a desired output power.

Continuing to refer to FIG. 1, the motor drive system 130 includes a variable frequency drive unit 131, a power frequency drive unit 132, and a control unit 133. The variable frequency drive unit 131, for example, may be implemented using a variable frequency driver configured to drive the first motor 120A in a variable frequency manner under the control of the control unit 133. The power frequency drive unit 132, for example, may be implemented using a power frequency (fixed frequency) driver configured to drive the second motor 120B at a fixed frequency under the control of the control unit 133. The control unit 133 is configured to cause the first compressor 110A to operate at the desired power driven by the first motor 120A and the second compressor 110B to operate at the desired power driven by the second motor 120B by controlling output power of the variable frequency drive unit 131 and the power frequency drive unit 132, thereby adapting a load demand of the screw chiller unit 10. By equipping different compressors with variable frequency drive units and power frequency drive units, the number of the variable frequency drivers can be reduced, which is advantageous for reducing equipment cost.

For exemplary purposes only, in the embodiment shown in FIG. 1, it is assumed that the number of both the first compressor 110A and the second compressor 110B is one. However, those skilled in the art will recognize after reading the specification of the present application that the disclosure of the present application is also suitable for situations where the compressors have other numbers. For example, the number of the first compressor is one and the number of the second compressor is two or more; or the number of the first compressor is two or more and the number of the second compressor is one or more.

In the embodiment shown in FIG. 1, the first compressor 110A and the second compressor 110B may be the same type of compressors or may be different types of compressors. In addition, optionally, when the compressors have different rated powers, the compressor with the higher rated power may be designated as the first compressor and the compressor with the lower rated power may be designated as the second compressor, i.e., the compressor with the higher rated power is equipped with the variable frequency drive unit and the compressor with the lower rated power is equipped with the power frequency drive unit.

The control logic of the control unit 133 for the variable frequency drive unit 131 and the power frequency drive unit 132 is further described below.

For the purpose of energy conservation and efficiency improvement, it is natural to prioritize the operation of the variable frequency drive unit in the screw chiller unit shown in FIG. 1. For example, when the load demand of the screw chiller unit rises, priority is given to increasing the output power of the variable frequency drive unit 131 to adapt to the rise in the load demand. Only when the output power of the variable frequency drive unit 131 reaches the maximum value and still fails to adapt to the load demand, should the operation of the power frequency drive unit 132 be considered. On the other hand, when the load demand of the screw chiller unit decreases, priority is given to decreasing the output power of the power frequency drive unit 132. Only after the output power of the power frequency drive unit 132 reaches a minimum value, should the output power of the variable frequency drive unit 131 be considered for reduction. The control logic that prioritizes the operation of the variable frequency drive unit is hereinafter referred to as the "priority mode".

In the control logic to be described hereinafter as the "equalization mode", the variable frequency drive unit and the power frequency drive unit are enabled in a more equalized manner than in the priority mode. Specifically, when the load demand of the screw chiller unit starts to rise from zero, priority is still given to increasing the output power of the variable frequency drive unit 131 to adapt to the load demand, but unlike the priority mode, after the output power of the variable frequency drive unit 131 reaches a higher value (e.g., 70% of the maximum value), the subsequent load demand increment is adapted by alternately increasing the output power of the power frequency drive unit 132 and the variable frequency drive unit 131. On the other hand, when the load demand of the screw chiller unit decreases from a high point, the reduction in load demand is adapted by alternately decreasing the output power of the power frequency drive unit 132 and the variable frequency drive unit 131.

The inventors of the present application have found, after in-depth research, that when the following control logic (hereinafter referred to as the "crossover mode") is adopted, the effect of energy conservation and efficiency improvement can be significantly improved as compared with the abovementioned priority mode and equalization mode.

Table 1 gives an example of the output power $P_{VFD}$ of the variable frequency drive unit 131 and the output power $P_{FD}$ of the power frequency drive unit 132 in the crossover mode vary in response to an increase in the load demand TOL_CAP. In Table 1, the output power $P_{VFD}$ and $P_{FD}$ are expressed as a percentage with respect to a maximum value of the respective output power, and the load demand TOL_CAP is expressed as a percentage with respect to the maximum load demand.

TABLE 1

| TOL_CAP | $P_{VFD}$ | $P_{FD}$ |
|---|---|---|
| 0 | 0 | 0 |
| 7.5 | 15 | 0 |
| 17.5 | 35 | 0 |
| 20 | 40 | 0 |
| 22.5 | 45 | 0 |
| 25 | 50 | 0 |
| 27.5 | 55 | 0 |
| 30 | 60 | 0 |
| 32.5 | 65 | 0 |
| 35 | 70 | 0 |
| 37.5 | 75 | 0 |
| 40 | 80 | 0 |
| 50 | 50 | 50 |
| 52.5 | 50 | 55 |
| 57.5 | 50 | 65 |
| 60 | 50 | 70 |
| 62.5 | 50 | 75 |
| 65 | 50 | 80 |
| 67.5 | 50 | 85 |
| 70 | 50 | 90 |
| 72.5 | 50 | 95 |
| 75 | 50 | 100 |
| 77.5 | 55 | 100 |
| 80 | 60 | 100 |
| 82.5 | 65 | 100 |
| 85 | 70 | 100 |
| 90 | 80 | 100 |
| 95 | 90 | 100 |
| 100 | 100 | 100 |

Table 2 gives an example of the output power PVFD of the variable frequency drive unit 131 and the output power PFD of the power frequency drive unit 132 in the crossover mode vary in response to a decrease in the load demand TOL_CAR. In Table 2) the output power PVFD and PFD are expressed as a percentage with respect to a maximum value of the respective output power, and the load demand TOL_CAP is expressed as a percentage with respect to the maximum load demand.

TABLE 2

| TOL_CAP | $P_{VFD}$ | $P_{FD}$ |
|---|---|---|
| 100 | 100 | 100 |
| 95 | 90 | 100 |
| 80 | 80 | 100 |
| 85 | 70 | 100 |
| 80 | 60 | 100 |
| 75 | 50 | 100 |
| 72.5 | 50 | 95 |
| 70 | 50 | 90 |
| 67.5 | 50 | 85 |
| 65 | 50 | 80 |
| 62.5 | 50 | 75 |
| 60 | 50 | 70 |
| 57.5 | 50 | 65 |
| 55 | 50 | 60 |
| 52.5 | 50 | 55 |
| 50 | 50 | 50 |
| 45 | 45 | 45 |
| 40 | 80 | 0 |
| 35 | 70 | 0 |
| 30 | 60 | 0 |
| 25 | 50 | 0 |
| 20 | 40 | 0 |
| 15 | 30 | 0 |
| 10 | 20 | 0 |

In the examples shown in Tables 1 and 2) the load demand TOL_CAP of the screw chiller unit is divided into the following multiple intervals:

Interval I: [0, 40%]
Interval II: (40%) 50%)
Interval III: [50%) 75%)
Interval IV: [75%, 100%].

Interval I

When the load demand TOL_CAP is within the interval I, the load demand is adapted by operating only the variable frequency drive unit 131. For example, the variable frequency drive unit 131 is operated at a variable output power to adapt to changes in the load demand within the interval I. In this example, an upper limit of 40% of the interval I is equivalent to a critical point or critical value (hereinafter referred to as the first critical value $T_1$). When this critical value is not exceeded, only the variable frequency drive unit 131 is in operation. Once exceeded, the power frequency drive unit 132 is operated in concert with the variable frequency drive unit 131 to match the desired load demand.

Interval II

After the load demand TOL_CAP enters the interval II, the load demand is adapted by operating the variable frequency drive unit 131 and the power frequency drive unit 132 simultaneously. In particular, when the load demand increases from 40% to 50%, the load demand is adapted by gradually decreasing the output power of the variable frequency drive unit 131 and gradually increasing the output power of the power frequency drive unit 132. On the other hand, when the load demand decreases from 50% to 40%, the decreased load demand is adapted by simultaneously decreasing the output power of the variable frequency drive unit 131 and the output power of the power frequency drive unit 132.

Table 3 gives an example of the output power $P_{VFD}$ of the variable frequency drive unit 131 and the output power $P_{FD}$ of the power frequency drive unit 132 vary with the increase of the load demand TOL_CAP when the load demand TOL_CAP is within the interval II.

TABLE 3

| TOL_CAP | $P_{VFD}$ | $P_{FD}$ |
|---|---|---|
| 40 | 80 | 0 |
| 47.5 | 80 | 15 |
| 50 | 80 | 20 |
| 50 | 75 | 25 |
| 50 | 70 | 30 |
| 50 | 65 | 35 |
| 50 | 60 | 40 |
| 50 | 55 | 45 |
| 50 | 50 | 50 |

In the example shown in Table 3, when the load demand TOL_CAP reaches 50%, the output power of the variable frequency drive unit 131 is rapidly reduced from 80% to 50%, and at the same time, the output power of the power frequency drive unit 132 is increased from 20% to 50% to compensate for the reduction in the output power of the variable frequency drive unit 131, so that the overall output power of the first and second compressors is adapted to the load demand.

Table 4 gives an example of the output power $P_{VFD}$ of the variable frequency drive unit 131 and the output power $P_{FD}$ of the power frequency drive unit 132 vary with the decrease of the load demand TOL_CAP when the load demand TOL_CAP is within the interval II.

TABLE 4

| TOL_CAP | $P_{VFD}$ | $P_{FD}$ |
|---|---|---|
| 50 | 50 | 50 |
| 45 | 45 | 45 |
| 40 | 40 | 40 |
| 40 | 80 | 0 |

In the example shown in Table 4, when the load demand TOL_CAP reaches 40% (the aforementioned first critical value $T_1$), the output power of the variable frequency drive unit 131 is rapidly increased from 40% to 80%, and at the same time, the output power of the power frequency drive unit 132 is rapidly reduced from 40% to 0, so that the overall output power of the first and second compressors remains adapted to the load demand.

Interval III

When the load demand TOL_CAP is within the interval III, the load demand is adapted by simultaneously operating the variable frequency drive unit 131 and the power frequency drive unit 132. In particular, the variation of the load demand within the interval III is adapted by operating the variable frequency drive unit 131 at a first output power $P_1$ and operating the power frequency drive unit 132 at a variable output power. In this example, a lower limit of 50% of the interval III is equivalent to a critical point or critical value (hereinafter referred to as the second critical value $T_2$). Once this critical value is exceeded, the variable frequency drive unit 131 will operate at a fixed output power $P_1$. Optionally, the output power $P_1$ may be set to be less than the output power of the variable frequency drive unit 131 when the load demand is equal to the first critical value $T_1$ (e.g., 80% of the maximum output power of the variable frequency drive unit 131 as shown in Table 1). For example, the output power $P_1$ may be set to 50% of the maximum output power of the variable frequency drive unit 131 as shown in Table 1.

Interval IV

When the load demand TOL_CAP is within the interval IV, the variation of the load demand within the interval IV is adapted by operating the variable frequency drive unit 131 at a variable output power and operating the power frequency drive unit 132 at the second output power $P_2$. In this example, a lower limit of 75% of the interval IV is equivalent to a critical point or critical value (hereinafter referred to as the third critical value $T_3$). Once this critical value is exceeded, the variable frequency drive unit 131 will operate at a variable output power and the power frequency drive unit 132 will operate at a fixed output power. Optionally, the output power P2 may be set to the maximum output power of the power frequency drive unit 132.

Figure 2:
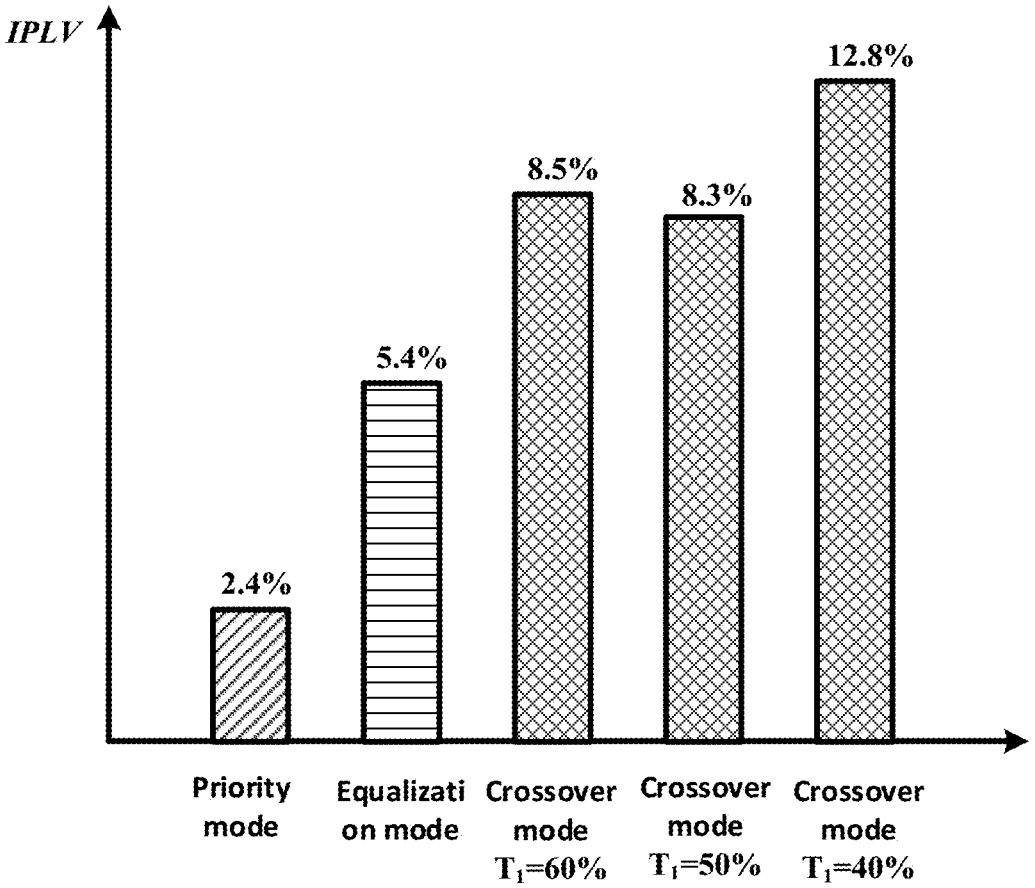
FIG. 2 shows comparative results of the operational performance of a screw chiller unit when using crossover mode, equalization mode, and priority mode.

FIG. 2 shows comparative results of the operational performance of a screw chiller unit when using crossover mode, equalization mode, and priority mode, wherein the crossover mode is based on the exemplary approach shown in Tables 1 and 2 and comprises cases in which the first critical value $T_1$ is taken to be, for example, 40%, 50%, and 60%. In FIG. 2, the vertical axis is the integrated part-load performance factor (IPLV) used to describe the operational performance of the screw chiller unit.

As may be seen in FIG. 2, the IPLVs in the crossover mode are all higher than those in the equalization and priority modes, which indicates that the adoption of the crossover mode as the control logic for both the variable frequency drive unit and the power frequency drive unit can significantly improve the effect of energy conservation and efficiency improvement.

It should be noted that the interval division methods of load demand shown in Tables 1 and 2 are merely exemplary. Optionally, the upper limit or first critical value T1 of the interval I may be determined based on the types of the first and second compressors. For example, when the first and second compressors have different types, the first critical value $T_1$ may be set to about 40% of the rated load demand of the screw chiller unit. When the first and second compressors have the same types, the first critical value $T_1$ may be set to about 50% of the rated load demand of the screw chiller unit. Furthermore, the number of intervals shown in Tables 1 and 2 are also non-limiting. For example, in some other examples, the load demand TOL_CAP of the screw chiller unit is divided into the following multiple intervals:

Interval I': [0, 50%]

Interval II': (50%, 75%)

Interval III': [75%, 100%].

In the above-described division, the first critical value $T_1$ and the second critical value $T_2$ may be combined into a critical value T. For example, when the critical value T is not exceeded, only the variable frequency drive unit 131 is in operation, whereas once the critical value T is exceeded, the variable frequency drive unit 131 will be operated at a fixed output power $P_1'$ and the power frequency drive unit 132 will be operated at a variable output power. Optionally, the output power $P_1'$ may be set to a smaller output power (e.g., 50%) relative to the output power (e.g., 80%) of the variable frequency drive unit 131 at the upper limit of the interval I.

Figure 3:
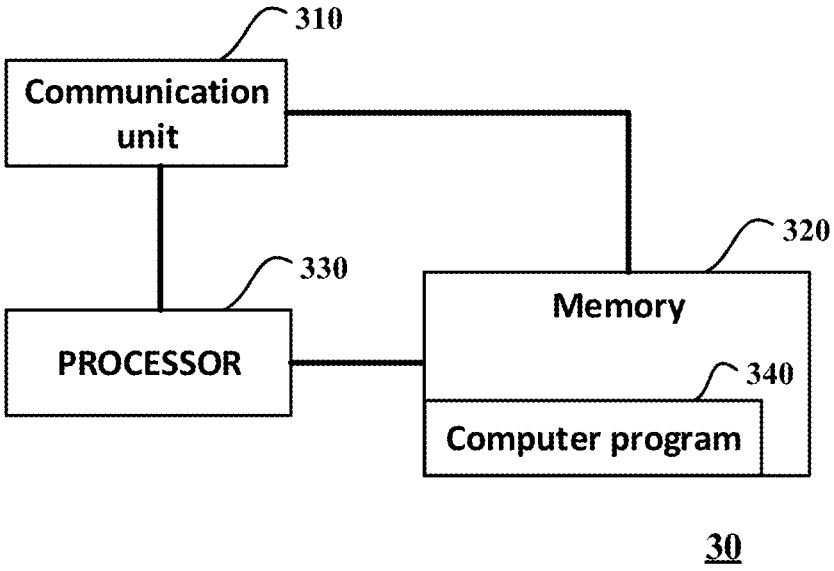
FIG. 3 is a schematic block diagram of a typical processing device.

FIG. 3 is a schematic block diagram of a typical processing device. The processing device shown in FIG. 3 may be used to implement the control unit in the motor drive system shown in FIG. 1.

As shown in FIG. 3, a processing device 30 comprises a communication unit 310, a memory 320 (e.g., a non-volatile memory such as a flash memory, a ROM, a hard disk drive, a magnetic disk, a CD-ROM, or the like), a processor 330, and a computer program 340.

The communication unit 310 serves as a communication interface configured to establish a communication connection between the processing device and an external device (e.g., a variable frequency drive unit 131, a power frequency drive unit 132, a sensor, etc.) or a network (e.g., the Internet).

The memory 320 stores the computer program 340 that may be executed by the processor 330. In addition, the memory 320 may also store data generated by the processor 330 when executing the computer program and data or commands received externally via the communication unit 310.

The processor 330 is configured to run the computer program 340 stored on the memory 320 and to access data on the memory 320.

Figure 4:
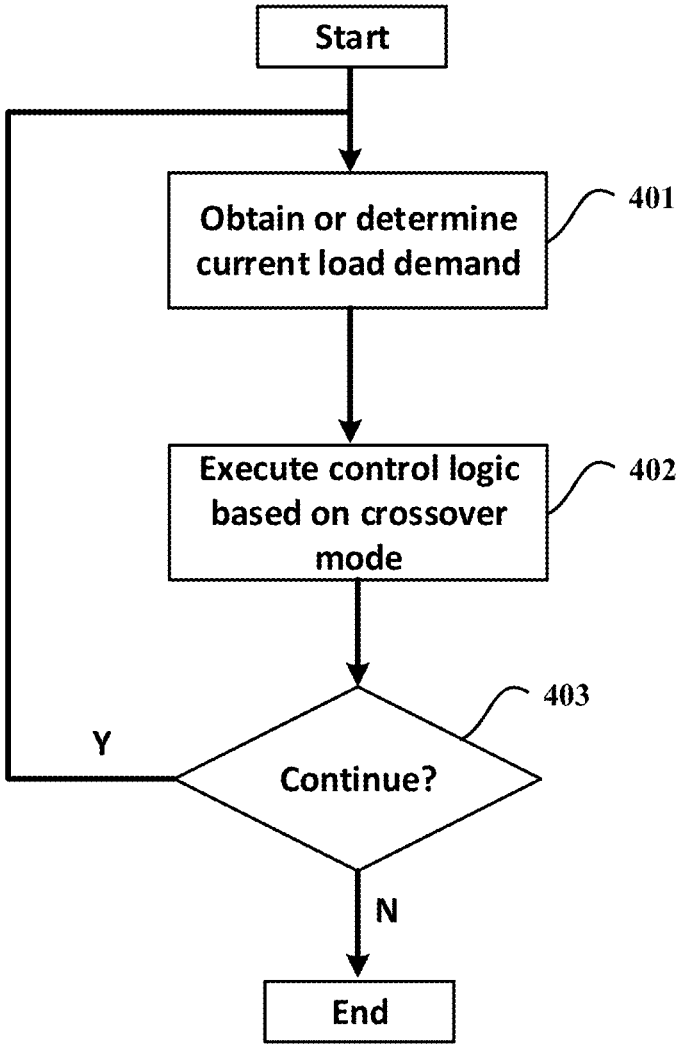
FIG. 4 is a flowchart of a control method for a screw chiller unit in accordance with some other embodiments of the present application.

FIG. 4 is a flowchart of a control method for a screw chiller unit in accordance with some other embodiments of the present application. Exemplarily, the method described below is realized with the aid of the processing device shown in FIG. 3. That is, the computer program 340 in FIG. 3 may include computer instructions for implementing the various steps of the method described below, such that the corresponding method may be implemented when the computer program 340 is run on the processor 330.

The method shown in FIG. 4 includes the following steps:

Step 401: The processing device 30 obtains or determines a current load demand of the screw chiller unit 10.

Step 402: The processing device 30 executes the control logic based on the aforementioned crossover mode based on the current load demand obtained or determined in step 401, so as to adapt the load demand of the screw chiller unit 10 by controlling the output power of the variable frequency drive unit 131 and the power frequency drive unit 132.

The control logic based on the crossover mode has been described in detail above and will not be repeated here.

Step 403: The processing device 30 determines whether it is necessary to continue executing the control logic, and if so, returns to step 401, otherwise, exits the process shown in FIG. 4.

In accordance with another aspect of the present application, there is also provided a computer-readable storage medium on which is stored a computer program which, when executed by the processor, may implement one or more of the steps contained in the method described above with the aid of FIG. 4.

The computer-readable storage medium referred to in the application includes various types of computer storage media, which may be any usable medium that may be accessed by a general-purpose or specialized computer. Byway of example, the computer-readable storage medium may include RAM, ROM, EPROM, E2PROM, registers, hard disks, removable disks, CD-ROM or other optical disk memories, magnetic disk memories, or other magnetic storage devices, or any other temporary or non-transitory medium that may be used to carry or store desired program code units in the form of instructions or data structures and may be accessed by general-purpose or special-purpose computers, or general-purpose or special-purpose processors. Combinations of the foregoing should also be included within the scope of protection of computer-readable storage medium. Exemplary storage medium are coupled to a processor to enable the processor to read and write information from/to the storage medium. In alternative embodiments, the storage medium may be integrated into the processor. The processor and the storage medium may reside in an ASIC. The ASIC may reside in a user terminal. In alternative embodiments, the processor and the storage medium may reside in the user terminal as discrete components.

Those skilled in the art will appreciate that various illustrative logical blocks, modules, circuits, and algorithm steps described herein may be implemented as electronic hardware, computer software, or combinations of both.

To demonstrate this interchangeability between the hardware and software, various illustrative components, blocks, modules, circuits, and steps have been described above generally in terms of their functionality. Whether such functionality is implemented in hardware or software depends on the particular application and design constraints imposed on the overall system. Those skilled in the art may implement the described functionality in changing ways for the particular application. However, such implementation decisions should not be interpreted as causing a departure from the scope of the present application.

Although only a few of the specific embodiments of the present application have been described, those skilled in the art will appreciate that the present application may be embodied in many other forms without departing from the spirit and scope thereof. Accordingly, the examples and implementations shown are to be regarded as illustrative and not restrictive, and various modifications and substitutions may be covered by the application without departing from the spirit and scope of the application as defined by the appended claims.

The embodiments and examples presented herein are provided to best illustrate embodiments in accordance with the present technology and its particular application, and to thereby enable those skilled in the art to implement and use the present application. However, those skilled in the art will appreciate that the above description and examples are provided for convenience of illustration and example only. The presented description is not intended to cover every aspect of the application or to limit the application to the precise form disclosed.

What is claimed is:

1. A motor drive system for a chiller unit, the chiller unit comprising a first compressor, a first motor for the first compressor, a second compressor and a second motor for the second compressor, the motor drive system comprising:

a variable frequency drive unit configured to drive the first motor;

a power frequency drive unit configured to drive the second motor;

a control unit configured to adapt a load demand of the chiller unit by controlling output power of the variable frequency drive unit and the power frequency drive unit;

wherein the control unit controls the output of the variable frequency drive unit and the fixed frequency drive unit by:

adapting the load demand by operating the variable frequency drive unit and the fixed frequency drive unit when the load demand is greater than a second critical value and less than a third critical value.

2. The motor drive system of claim 1, wherein a rated power of the first compressor is greater than or equal to a rated power of the second compressor.

3. The motor drive system of claim 1, wherein the control unit controls the output power of the variable frequency drive unit and the power frequency drive unit by one or more of:

adapting the load demand by operating only the variable frequency drive unit when the load demand is less than or equal to a first critical value, wherein the variable frequency drive unit is operated at a variable output power;

wherein the variable frequency drive unit is operated at a first output power and the power frequency drive unit is operated at a variable output power, wherein the second critical value is greater than or equal to the first critical value; and/or adapting the load demand by operating the variable frequency drive unit and the power frequency drive unit when the load demand is greater than or equal to the third critical value, wherein the variable frequency drive unit is operated at a variable output power and the power frequency drive unit is operated at a second output power.

4. The motor drive system of claim 3, wherein the first output power is less than the output power of the variable frequency drive unit when the load demand is equal to the first critical value, and the second output power is equal to a maximum output power of the power frequency drive unit.

5. A chiller unit comprising:

the motor drive system as claimed in claim 1.

6. A control method for a chiller unit, the chiller unit comprising a first compressor, a first motor for the first compressor, a second compressor and a second motor for the second compressor, the method comprising:

utilizing a variable frequency drive unit and a power frequency drive unit to drive the first motor and the second motor respectively, wherein a load demand of the chiller unit is adapted by controlling output power of the variable frequency drive unit and the power frequency drive unit; and controlling the output of the variable frequency drive unit and the fixed frequency drive unit by: adapting the load demand by operating only the variable frequency drive unit when the load demand is less than or equal to a first critical value.

7. The method of claim 6, wherein a rated power of the first compressor is greater than or equal to a rated power of the second compressor.

8. The method of claim 6, wherein the output power of the variable frequency drive unit and the power frequency drive unit is controlled in the following manner:

adapting the load demand by operating the variable frequency drive unit and the power frequency drive unit when the load demand is greater than a second critical value and less than a third critical value, wherein the variable frequency drive unit is operated at a first output power and the power frequency drive unit is operated at a variable output power, wherein the second critical value is greater than or equal to the first critical value; and adapting the load demand by operating the variable frequency drive unit and the power frequency drive unit when the load demand is greater than or equal to the third critical value, wherein the variable frequency drive unit is operated at a variable output power and the power frequency drive unit is operated at a second output power.

9. The method of claim 8, wherein the first output power is less than the output power of the variable frequency drive unit when the load demand is equal to the first critical value, and the second output power is equal to a maximum output power of the power frequency drive unit.

10. A computer-readable storage medium, the computer-readable storage medium having instructions stored therein, characterized in that the instructions, when executed by a processor, cause the processor to perform the method as claimed in claim 6.

11. The method according to claim 6, wherein the power frequency drive unit is operated at a fixed frequency.

12. A motor drive system for an air conditioning unit, the air conditioning unit comprising a first compressor, a first motor for the first compressor, a second compressor and a second motor for the second compressor, the motor drive system comprising:

a variable frequency drive unit configured to drive the first motor;

a fixed frequency drive unit configured to drive the second motor;

a control unit configured to adapt a load demand of the chiller unit by controlling output power of the variable frequency drive unit and the fixed frequency drive unit; and the control unit controls the output of the variable frequency drive unit and the fixed frequency drive unit by: adapting the load demand by operating only the variable frequency drive unit when the load demand is less than or equal to a first critical value.

13. The motor drive system according to claim 12, wherein the control unit further controls the output of the variable frequency drive unit and the fixed frequency drive unit by: operating the variable frequency drive unit at a variable output power.

14. The motor drive system according to claim 12, wherein the control unit controls the output of the variable frequency drive unit and the fixed frequency drive unit by:

adapting the load demand by operating the variable frequency drive unit and the fixed frequency drive unit when the load demand is greater than a second critical value and less than a third critical value.

15. The motor drive system according to claim 14, wherein the control unit further controls the output of the variable frequency drive unit and the fixed frequency drive unit by:

operating the variable frequency drive unit at a first output power and the fixed frequency drive unit at a variable output power.

16. The motor drive system according to claim 15, wherein the second critical value is greater than or equal to the first critical value.

17. The motor drive system according to claim 12, wherein the control unit controls the output of the variable frequency drive unit and the power frequency drive unit by:

adapting the load demand by operating the variable frequency drive unit and the power frequency drive unit when the load demand is greater than or equal to the third critical value.

18. The motor drive system according to claim 17, wherein the control unit further controls the output of the variable frequency drive unit and the power frequency drive unit by:

operating the variable frequency drive unit at a variable output power and the fixed frequency drive unit at a second output power.

19. The motor drive system according to claim 12, wherein the fixed frequency drive unit is operated at a fixed frequency.

* * * * *